US007074024B2

(12) United States Patent
Satoh et al.

(10) Patent No.: US 7,074,024 B2
(45) Date of Patent: Jul. 11, 2006

(54) SCROLL-TYPE FLUID MACHINE HAVING A PATH TO PASS AND COOL THE FLUID

(75) Inventors: Tohru Satoh, Yokohama (JP); Tamotsu Fujioka, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 10/975,167

(22) Filed: Oct. 28, 2004

(65) Prior Publication Data

US 2005/0058563 A1 Mar. 17, 2005

Related U.S. Application Data

(62) Division of application No. 10/655,144, filed on Sep. 4, 2003, now Pat. No. 6,905,320, which is a division of application No. 10/241,166, filed on Sep. 11, 2002, now abandoned.

(30) Foreign Application Priority Data

Sep. 19, 2001 (JP) ..... 2001-284329

(51) Int. Cl.
*F01C 1/02* (2006.01)
*F04C 18/00* (2006.01)

(52) U.S. Cl. ..... 418/55.1; 418/83; 418/101; 417/243; 417/366

(58) Field of Classification Search ..... 418/55.1, 418/83, 101; 417/243, 366
See application file for complete search history.

(56) References Cited

U.S. PATENT DOCUMENTS

| | | | | |
|---|---|---|---|---|
| 3,285,327 | A | 11/1966 | Herrick | |
| 4,854,831 | A | 8/1989 | Etemad et al. | |
| 5,775,888 | A * | 7/1998 | Sakamoto et al. | 418/101 |
| 5,823,756 | A * | 10/1998 | Kawazoe | 418/55.4 |
| 6,190,145 | B1 * | 2/2001 | Fujioka et al. | 418/55.1 |
| 6,499,977 | B1 | 12/2002 | Barito et al. | |
| 6,736,620 | B1 * | 5/2004 | Satoh | 418/55.2 |

FOREIGN PATENT DOCUMENTS

| | | | |
|---|---|---|---|
| JP | 364000388 | A | 1/1989 |
| JP | 4043342801 | A | 11/1992 |
| JP | 405010278 | A | 1/1993 |
| JP | 405149276 | A | 6/1993 |
| JP | 08177764 | A * | 7/1996 |
| JP | 408247056 | A | 9/1996 |
| JP | 409053589 | A | 2/1997 |

* cited by examiner

*Primary Examiner*—Theresa Trieu

(57) ABSTRACT

A scroll-type fluid machine such as a scroll compressor or a scroll vacuum pump generates compression heat during compressing operation. A scroll body comprises a stationary scroll and an orbiting scroll that is revolved with respect to the stationary scroll eccentrically. The stationary scroll has a stationary wrap and the orbiting scroll has an orbiting wrap engaged with the stationary wrap to form a compression chamber therebetween. In the scroll-type fluid machine, a cooler is provided to cool high-temperature compressed air discharged from a discharge bore at the center of the stationary scroll.

3 Claims, 13 Drawing Sheets

SCROLL-TYPE FLUID MACHINE HAVING A PATH TO PASS AND COOL THE FLUID

This application is a divisional of U.S. application Ser. No. 10/655,144 filed Sep. 4, 2003 now U.S. Pat. No. 6,905,320 which is a divisional of U.S. application Ser. No. 10/241,166 filed Sep. 11, 2002 now abandoned.

BACKGROUND OF THE INVENTION

The present invention relates to a scroll-type fluid machine such as a scroll compressor or a scroll vacuum pump, and especially to a scroll-type fluid machine for improving cooling capability of air which is discharged from a scroll compressor.

When a scroll compressor is used as an air compressor, compression heat is generated during compressing operation and transmitted to each structural elements such as sealing members and bearings to decrease its mechanical life.

To prevent such problems, as shown in Japanese Patent Publication No.9-53589A, in a conventional scroll compressor, a cooling path that communicates with external air is provided between the outer surface of a stationary scroll and casing, and between the outer surface of an orbiting scroll and an electric motor or a casing that enclose it to forward air with a cooling fan at one end of a compressor body, thereby cooling the stationary and orbiting scrolls and an electric motor, etc.

However, in the above scroll compressor, air in a compression chamber is indirectly cooled With the stationary and orbiting scrolls, but compressed air from the compression chamber is directly discharged from an outlet to the outside to make cooling capability lower.

Thus, when high-temperature air discharged from the compression chamber is stored in an air tank or used for an air tool, pressure-storage efficiency is decreased and the lives of the air tools are likely to decrease.

To solve the problem a separate cooler is connected to the compressor to form a unit so that air discharged from the compression chamber may be cooled. But, addition of such a cooler makes the compressor unit larger to limit the place for installation of the fluid machine and increase manufacturing cost.

SUMMARY OF THE INVENTION

In view of the disadvantages as above, it is an object of the present invention to provide a scroll-type fluid machine for cooling high-temperature air discharged from a compression chamber without a separate cooler.

To achieve the object, according to the present invention, there is provided a scroll-type fluid machine comprising a stationary scroll having a stationary wrap which axially extends; an orbiting scroll having an orbiting wrap which is engaged with said stationary wrap of said stationary scroll, air being pressurized by revolving said orbiting scroll with respect to the stationary scroll; a discharge bore formed in the stationary scroll to discharge said pressurized air; and a cooler including a cooling path that communicate with said discharge bore to pass and cool said.

BRIEF DESCRIPTION OF THE DRAWINGS

The above and other features and advantages of the present invention will become more apparent from the following description with respect to embodiments as shown in appended drawings wherein.

DETAILED DESCRIPTION OF PREFERRED EMBODIMENTS

Figure 1:
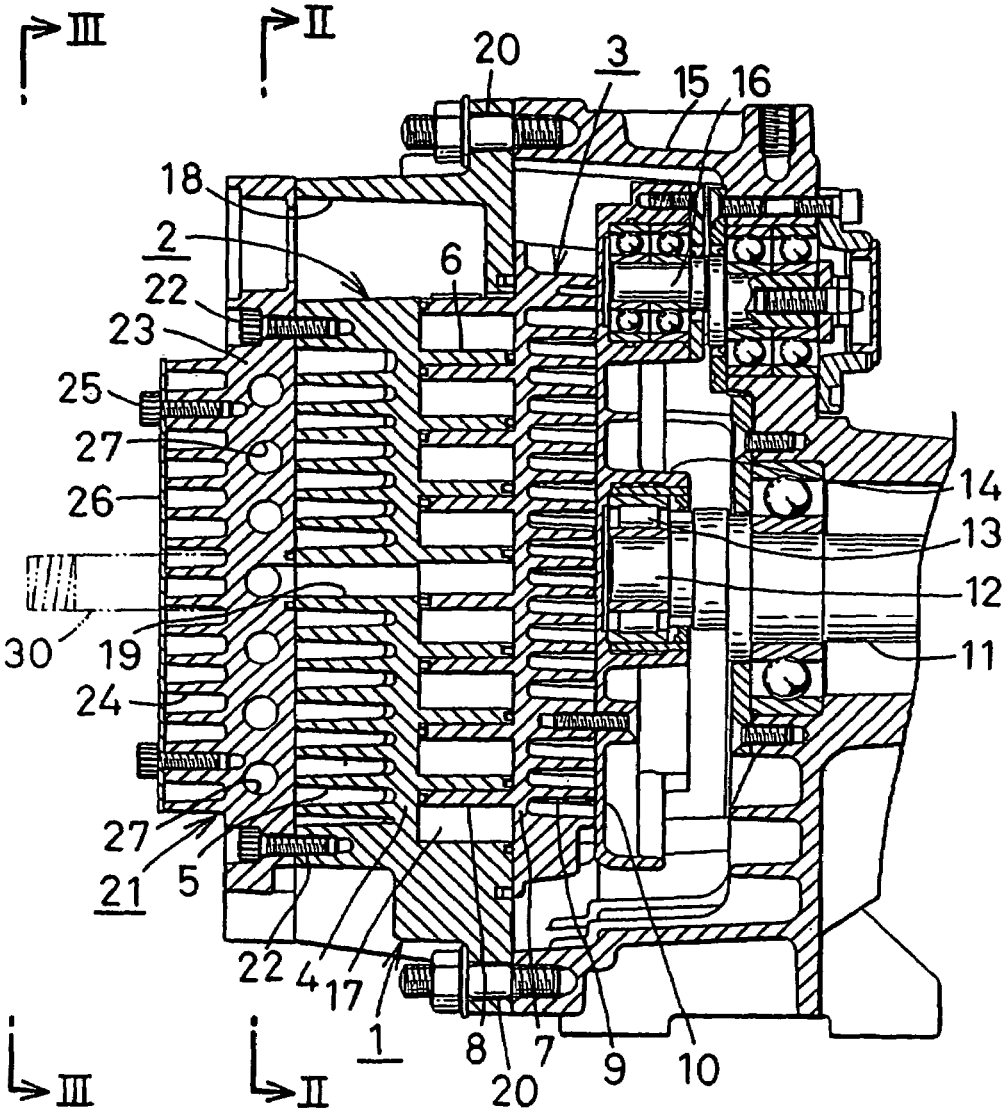
FIG. 1 is a vertical sectional side view of the first embodiment of a scroll air compressor that is a scroll-type fluid machine according to the present invention.

In FIG. 1, a scroll body 1 comprises a stationary scroll 2 and an orbiting scroll 3 driven by a motor (not shown). On the outer side surface or front surface (hereinafter, the left side of FIG. 1 will be as front.) of a stationary end plate 4 of the stationary scroll 2, cooling fins 5 for circulating cooling wind are suitably spaced and projected, and on the inner side surface or rear surface, a spiral stationary wrap 6 is axially projected.

On the front or outer side surface of the orbiting end plate 7 of the orbiting scroll 3, a spiral orbiting wrap 8 is projected forward and engaged with the stationary wrap 6. On the rear surface of the orbiting end plate 7, a plurality of cooling fins 9 for passing cooling wind are suitably spaced and projected.

On the rear end face of the orbiting scroll 3, a bearing plate 10 is bolted, and on the center of the rear surface, a tubular boss 14 is projected and engaged with an eccentric axial portion 12 of a drive shaft 11 connected to an orbiting shaft (not shown) of a motor.

Between the orbiting scroll 3 and a tubular housing 15 for storing it, there are three sets of known crank-pin type rotation-preventing mechanism 16 for preventing the orbiting scroll 3 from rotating on its own axis so that the orbiting scroll 3 may be revolved with respect to the stationary scroll at predetermined eccentricity.

Accordingly, volume between the orbiting scroll 3 and the stationary scroll 2 or between the orbiting wrap 8 and the stationary wrap 6 thereof gradually becomes smaller towards the center to form a compression chamber 17. Around the stationary scroll 2, an air intake bore 18 is provided, so that air that passes through a filter (not shown) is supplied into the compression chamber 17.

A discharge bore 19 that communicates with the compression chamber 17 is axially formed at the center of the stationary end plate 4 of the stationary scroll 2.

The flange of the stationary scroll 2 is fastened by clamp screws 20 to the front end opening of the housing 15 and integrally connected to the orbiting scroll 3.

On the front surface of the stationary scroll 2, a cooler 21 for cooling high-temperature compressed air discharged from the discharge bore 19 is fixed by a plurality of bolts 22 to contact or come closer with the front end of the cooling fin 5 projected on the stationary end plate 5.

Figure 2:
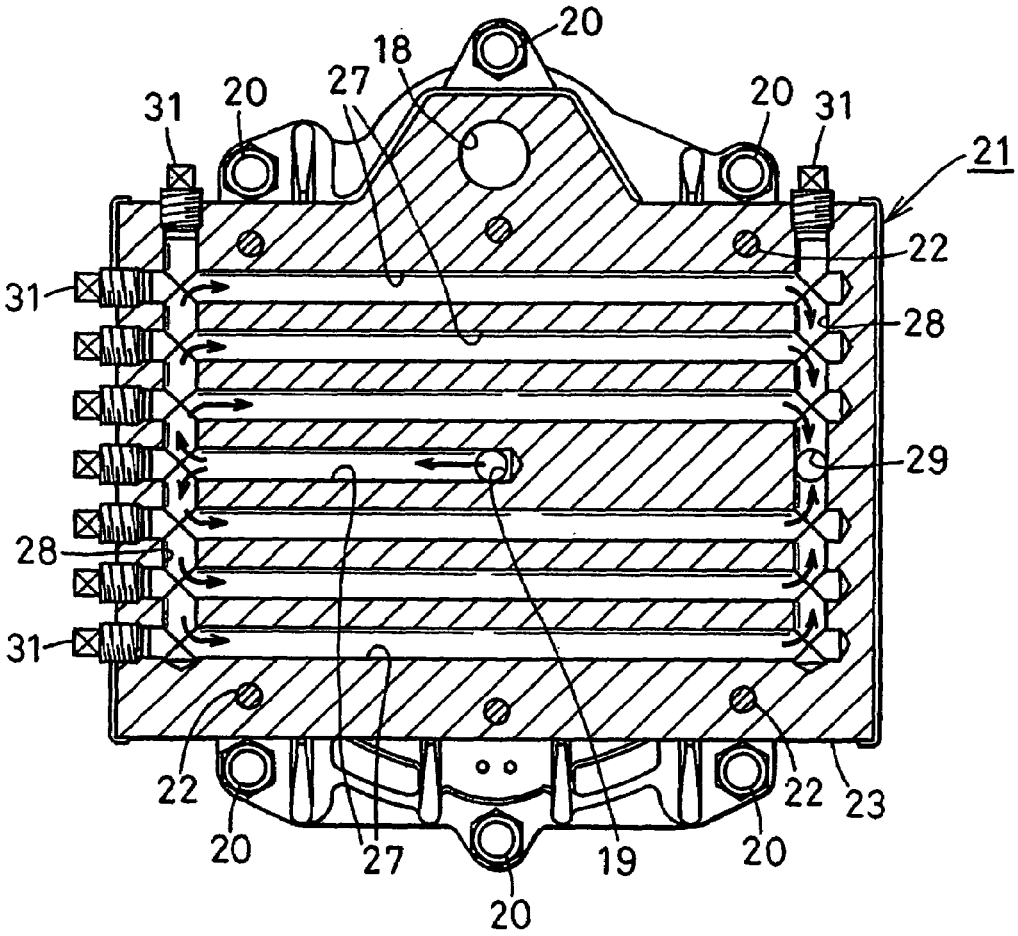
FIG. 2 is an enlarged vertical sectional front view taken along the line II—II in FIG. 1.
Figure 3:
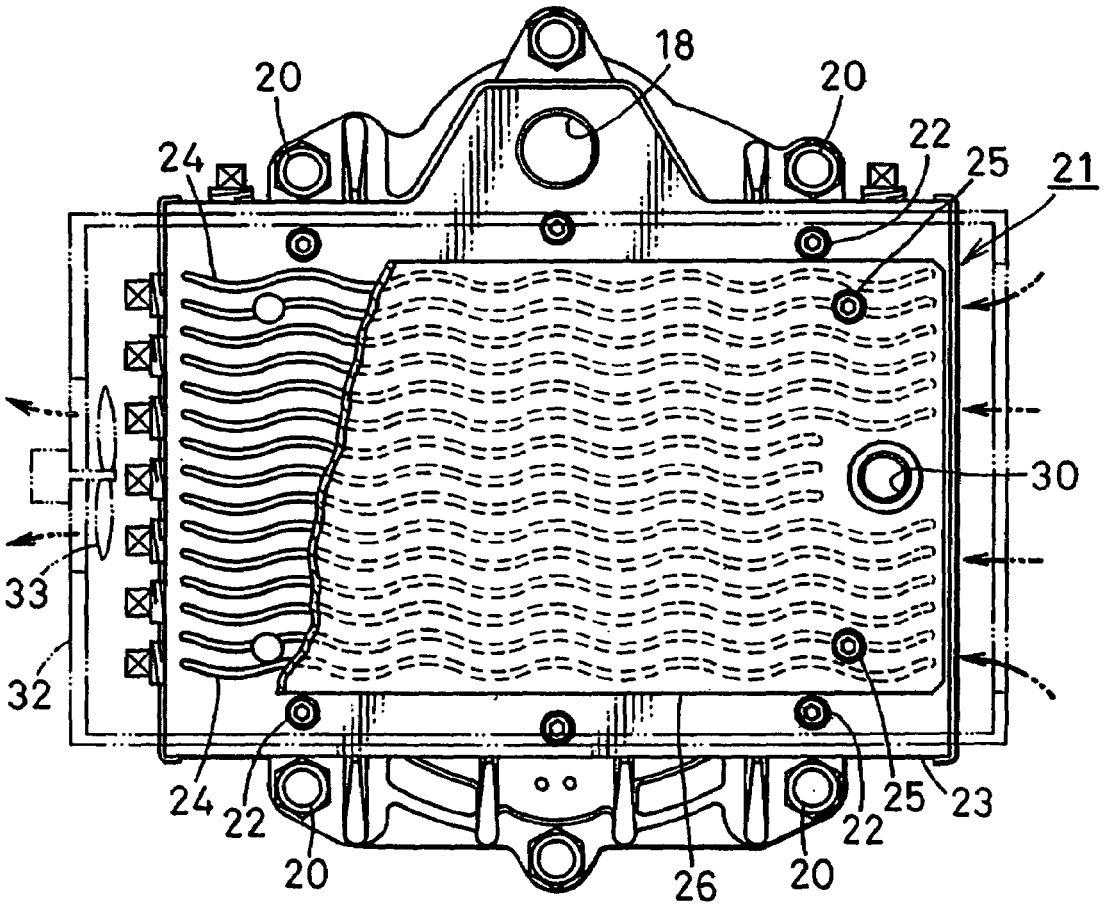
FIG. 3 is a partially cut-away view seen from the line III—III in FIG. 1.

As shown in FIGS. 2 and 3, the cooler 21 comprises a cooler body 23 that has substantially a rectangle and a plurality of fins 24 spaced vertically. Openings between the cooling fins 24 are closed by a cover 26 bolted to the cooler body 23.

As shown in FIG. 3, each of the cooling fin 24 is corrugated to increase contact area with external air. Gaps between the cooling fins 24 open only at the horizontal ends so that air may flow horizontally. The cooler 21 is made of high-thermal-conductivity material such as Al alloy or Cu alloy.

A plurality of cooling paths 24 are arranged in parallel in the cooler body 23, and the cooling paths 27 communicate with each other via vertical communicating paths 28, 28 to form a long cooling path.

The right end of the middle cooling path 27 which has a half length communicates with the discharge bore 19 at the center of the stationary scroll 2. In the middle of the right-side communicating path 28, there is formed a cooling outlet 29, which is connected to a discharge pipe 30. Numeral 31 denotes a plug for closing an opening when the cooling paths 27 and the communicating paths 28 are formed by a drill.

Air compressed in the compression chamber 17 of the scroll body 1 and discharged through the discharge bore 19 flows into the middle cooling path 27 as shown by arrows in FIG. 2. Thereafter, air flows to a cooling outlet 29 through a plurality of cooling paths 27, and is supplied to an air tank, an air tool etc. through a discharge pipe 30 connected to the cooling outlet 29.

When high-temperature air discharged from the compression chamber 17 passes through each of the cooling paths 27, it is cooled by the cooler body 23. A plurality of corrugated cooling fins 24 are projected on the cooler body 23, thereby providing suitable cooling and radiating properties, so that air which passes through the cooling path 27 is effectively cooled.

As shown by two-short-dash line in FIG. 3, the cooling fins 24 of the cooler 21 are surrounded by a blower duct 32 which opens at right and left sides. Air in the duct 32 may be discharged by a cooling or sucking fun 33 at one of the openings, thereby cooling the cooling fins 24 forcedly by air that flows in through the other opening. Thus, cooling effect by the cooler body 23 is increased, so that air in the cooling paths 27 is effectively cooled.

Figure 4:
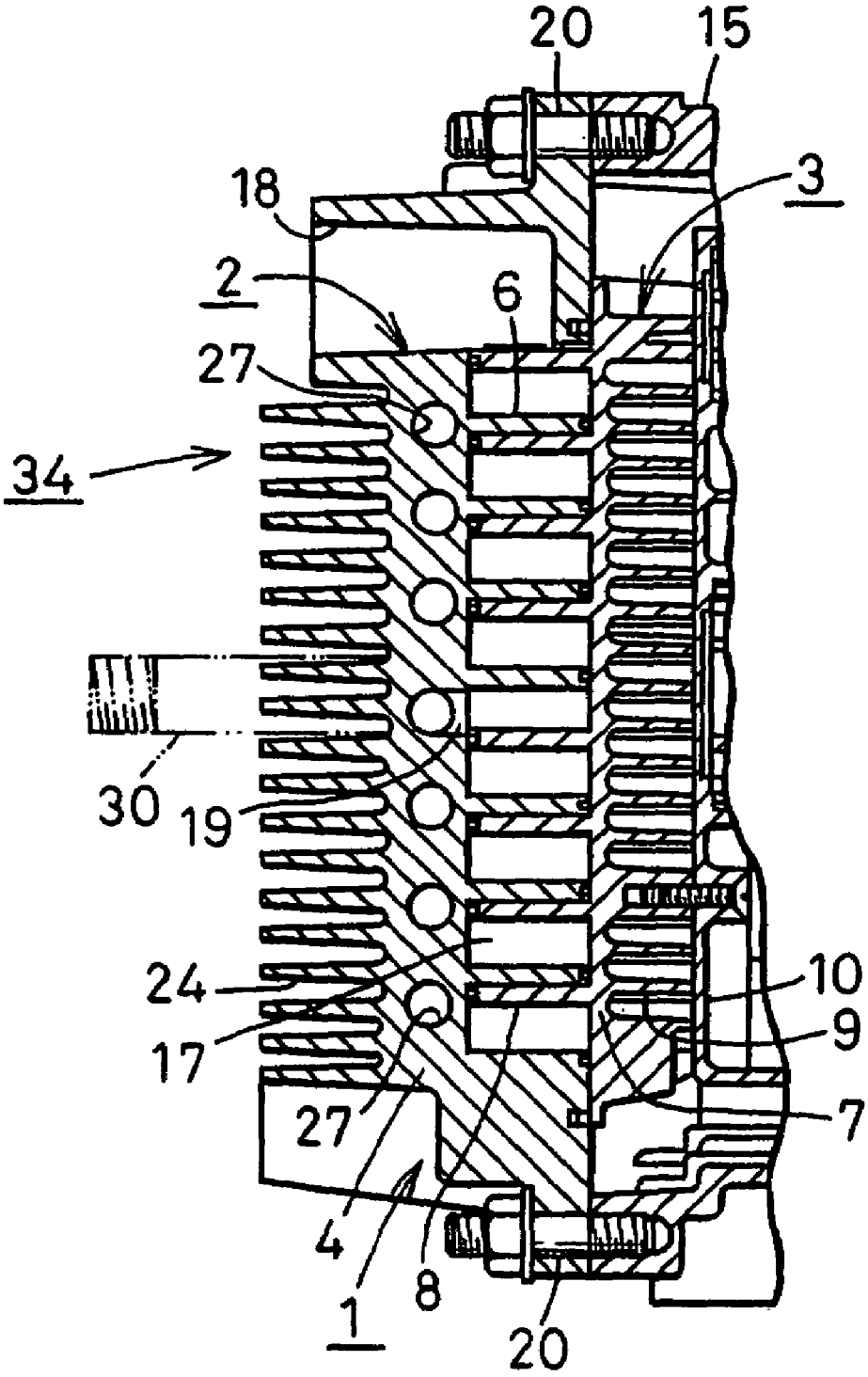
FIG. 4 is a vertical sectional side view of the second embodiment of the present invention.
Figure 4A:
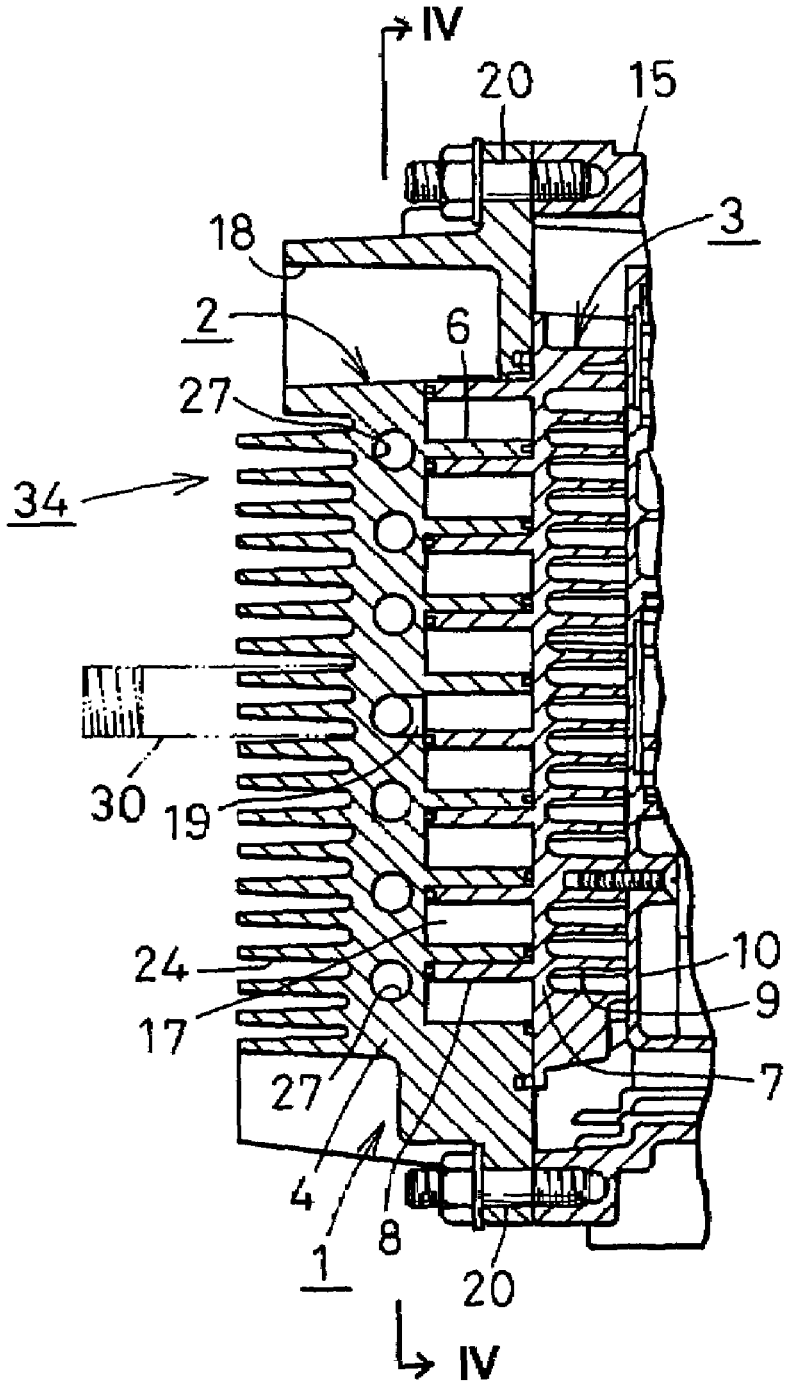
FIG. 4A is a vertical section side view of the second embodiment of the present invention.
Figure 4B:
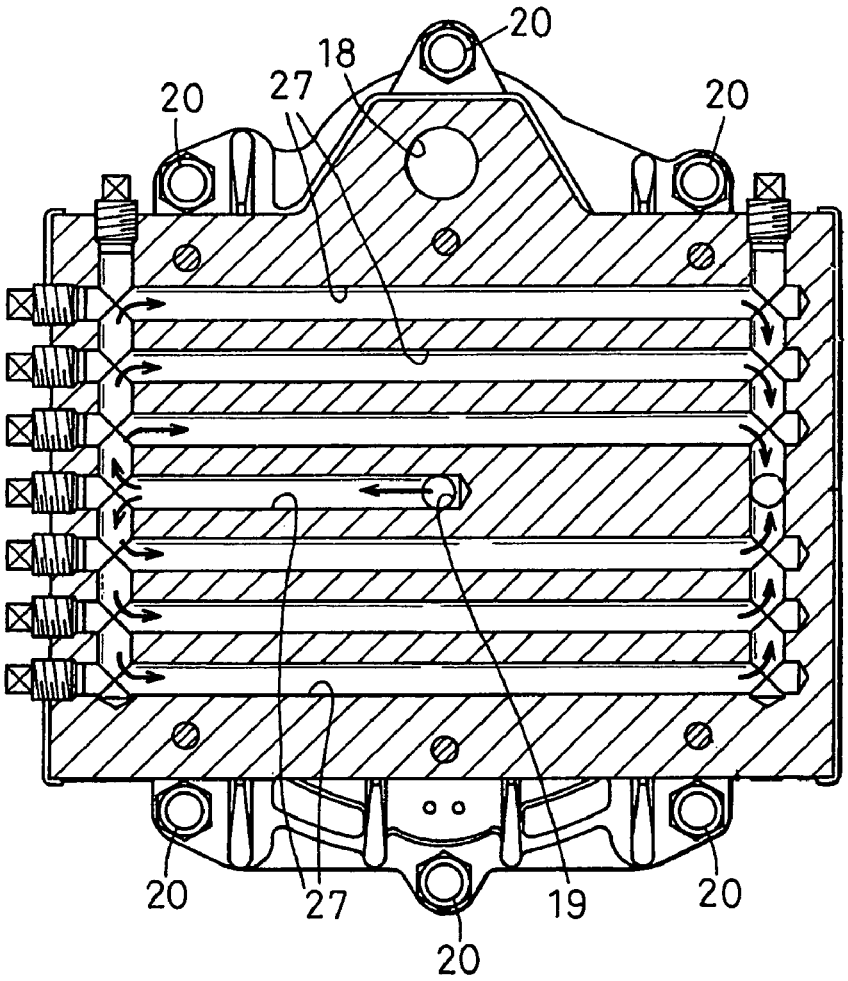
FIG. 4B is a vertical sectional view taken along the line IV—IV in FIG. 4A.
Figure 4C:
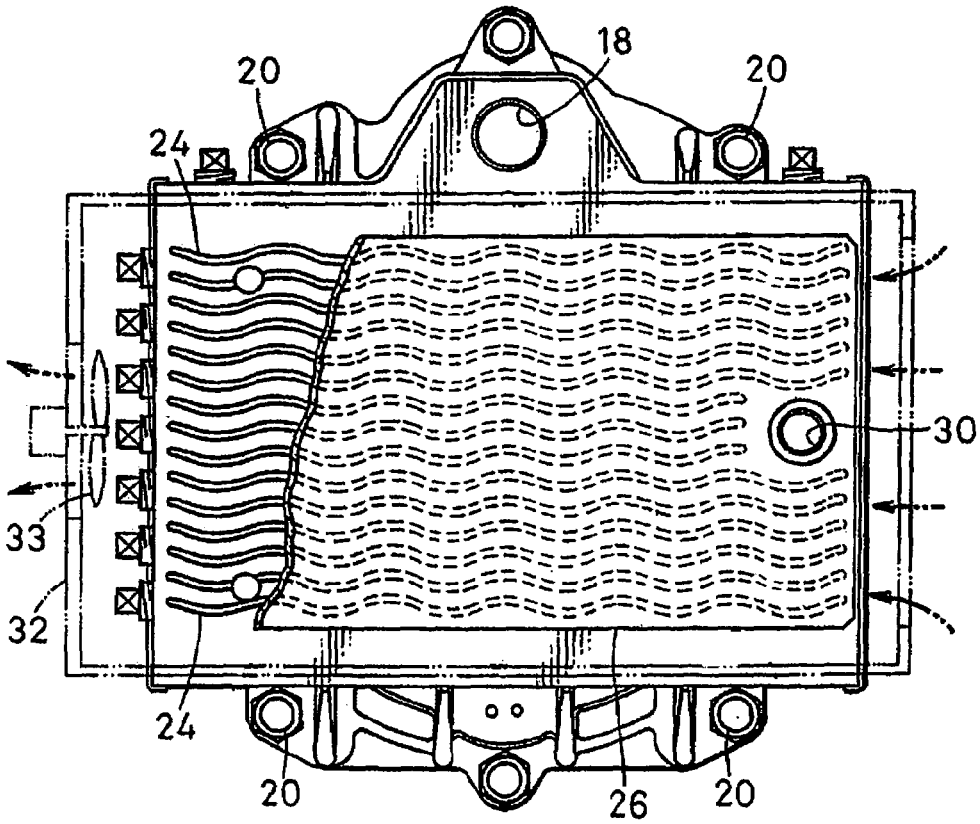
FIG. 4C is a front view of the second embodiment in FIG. 4A and similar to FIG. 3.

FIG. 4 illustrates the second embodiment of the present invention, in which the same numerals are assigned to members similar to those in the first embodiment and detailed description therefor is omitted. In this embodiment, a stationary scroll 2 itself acts as a cooler 34. That is to say, a stationary end plate 4 of a stationary scroll 2 is somewhat thick, and a cooling path 27 having the same shape as that in the first embodiment is formed in the stationary end plate. The middle cooling path 27 communicates with a discharge bore 19 at the center of the stationary scroll 2. On the front surface of the stationary end plate 4, a plurality of cooling fins 24 similar to those in the first embodiment project to increase cooling capability of the stationary end plate 4.

High temperature air discharged from a compression chamber 17 is not directly discharged from a discharge pipe 30, but is thermally radiated to the stationary end plate 4 when it flows in the cooling paths 27, thereby achieve efficient cooling. Temperature of the stationary end plate 4 rises by compression heat. So, compared with the first embodiment, lower cooling capability is achieved.

In this embodiment, the cooling fins 24 may be covered with a blower duct similar to that in the first embodiment so as to cool air forcedly by a sucking fan.

As shown by two-short-dash lines in FIG. 40, the cooling fins 24 on the stationary end plate 4 are surrounded by a blower duct 32 which opens at right and left sides. Air in the duct 32 may be discharged by a cooling or sucking fan 33 at one of the openings, thereby cooling the cooling fins 24 forcedly by air that flows in through the other opening as shown by arrows. The fan 33 may be a blowing fan for blowing air. Thus, cooling effect by the cooling fins 24 is increased so that air in the cooling paths 27 is effectively cooled.

Figure 5:
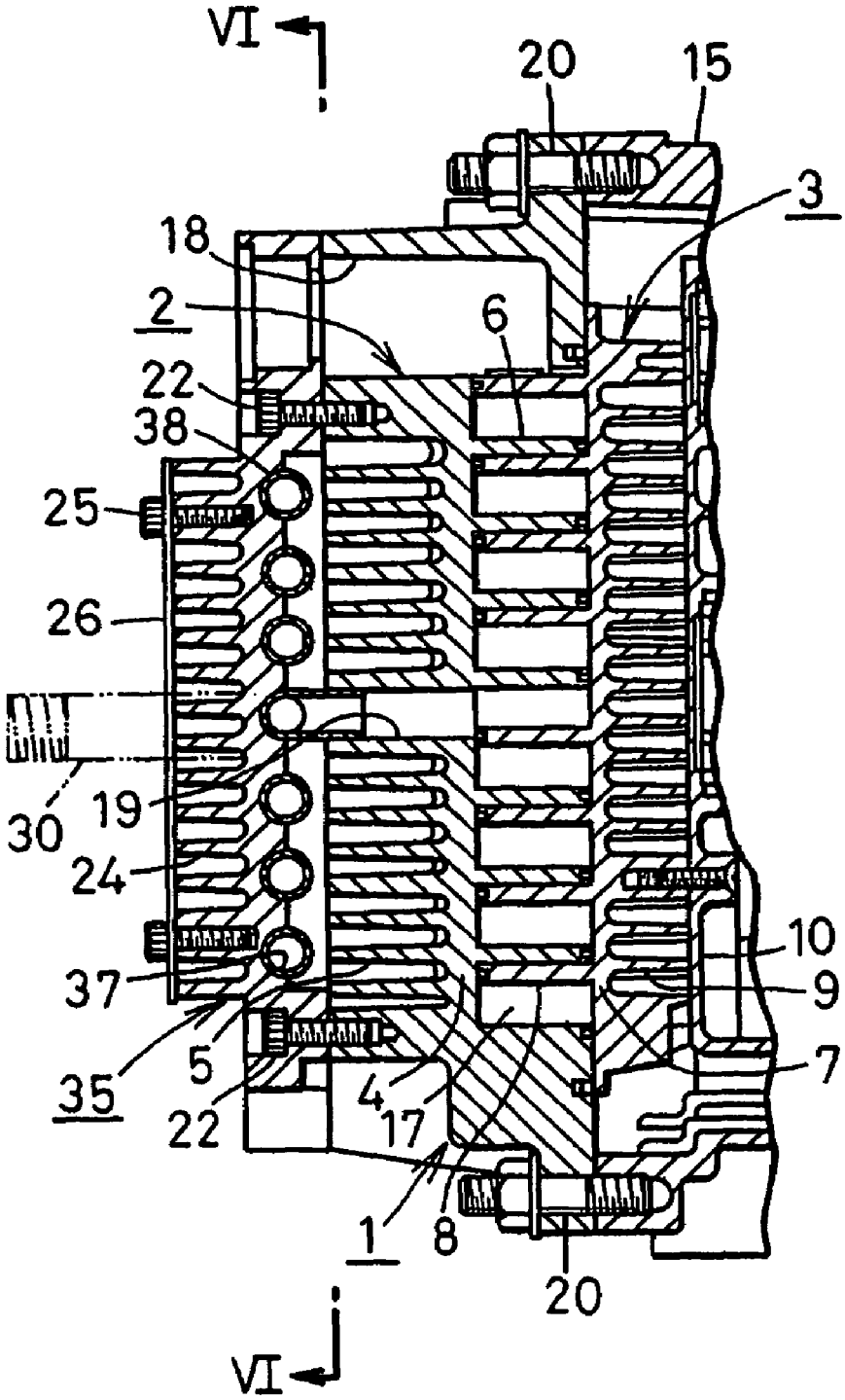
FIG. 5 is a vertical sectional side view of the third embodiment of the present invention.
Figure 6:
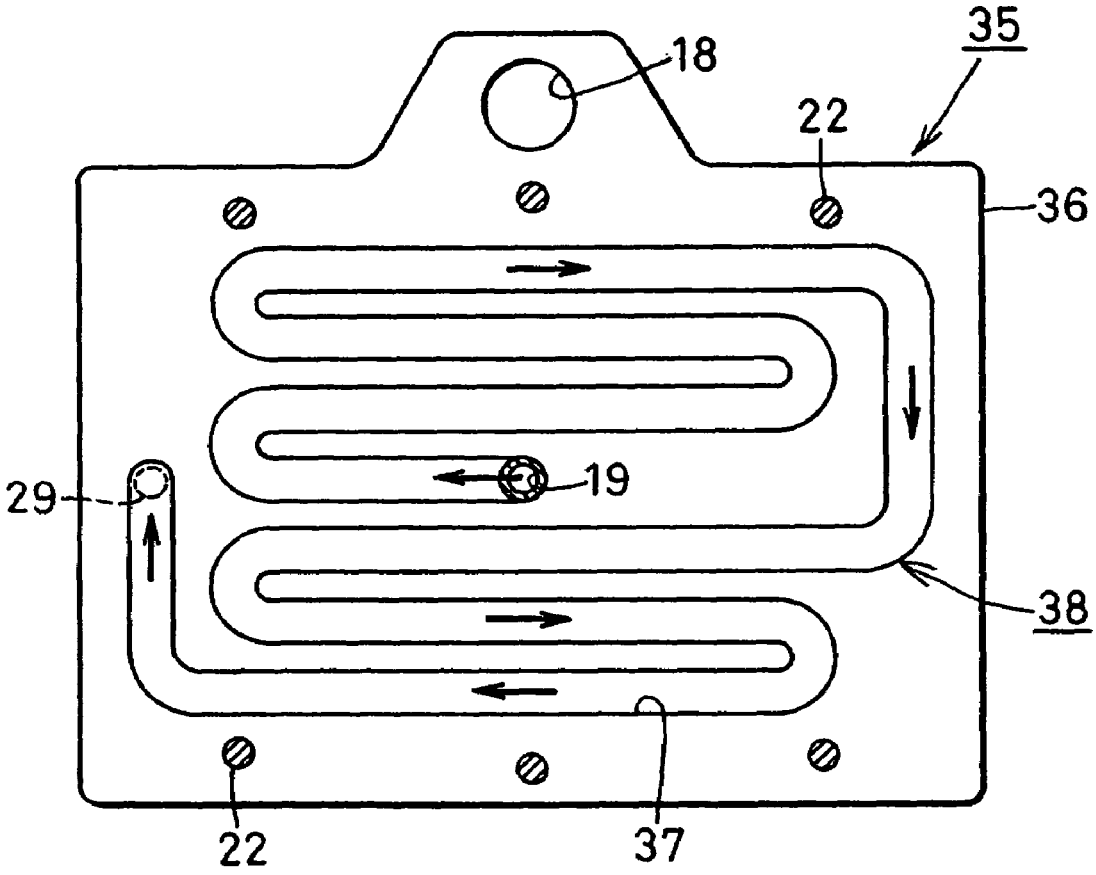
FIG. 6 is an enlarged vertical section rear view taken along the line VI—VI in FIG. 5.

FIGS. 5 and 6 show the third embodiment of the present invention, in which a tubular cooler 35 is mounted with bolts 22 to the front surface of a stationary scroll 2 similar to that of the first embodiment in FIG. 1.

The cooler 35 comprises a high-thermal-conductivity cooler body 36 made of Al alloy or Cu alloy, and a conduit 38 that is tightly engaged in a semi-circular sectioned meandering groove 37 on the rear surface of the cooler body 36. One end of the conduit 38 is connected to a discharge bore 19 at the center of the stationary scroll 2, and the other end is connected to a cooling outlet 29 of the cooler body 36. The conduit 38 is made of high thermally conductive material such as Cu.

A cover 26 similar to those in the foregoing embodiments is bolted to the cooling fin 24, but may be omitted.

In the third embodiment, high-temperature air discharged from a compression chamber 17 of the scroll body 1 flows into the conduit 38 and is discharged from a discharge pipe 30 connected to the cooling outlet 29.

The conduit 38 is heated with high-temperature air. But the conduit 38 has high thermal conductivity and large meandering length, so that heat is radiated to the cooler body 36 that has realtively low temperature. Thus, high-temperature air that flows through the conduit 38 is effectively cooled. In the third embodiment, only the conduit 38 may be mounted to the front of the stationary scroll 2 with a suitable fixing tool and touched to air directly for cooling.

Figure 7:
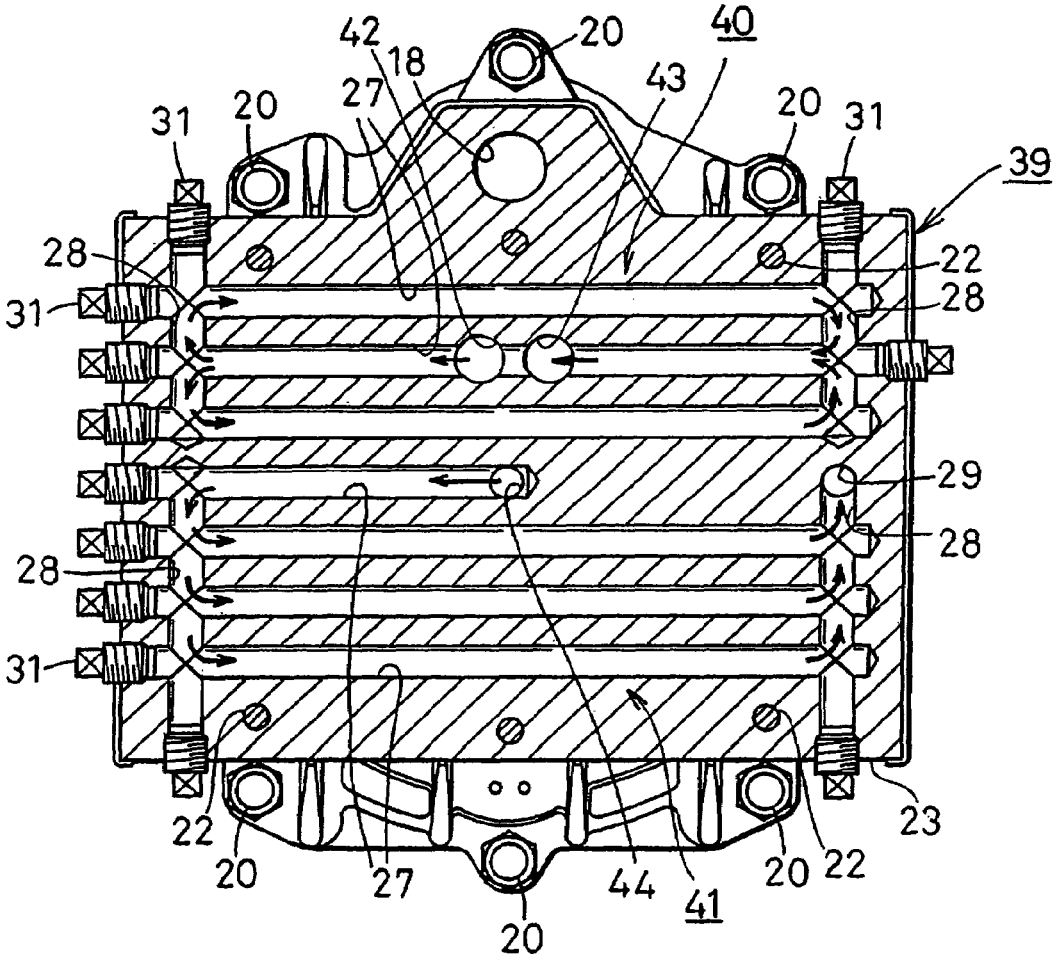
FIG. 7 is an enlarged vertical sectional front view of the fourth embodiment according to the present invention, similar to FIG. 2.
Figure 8:
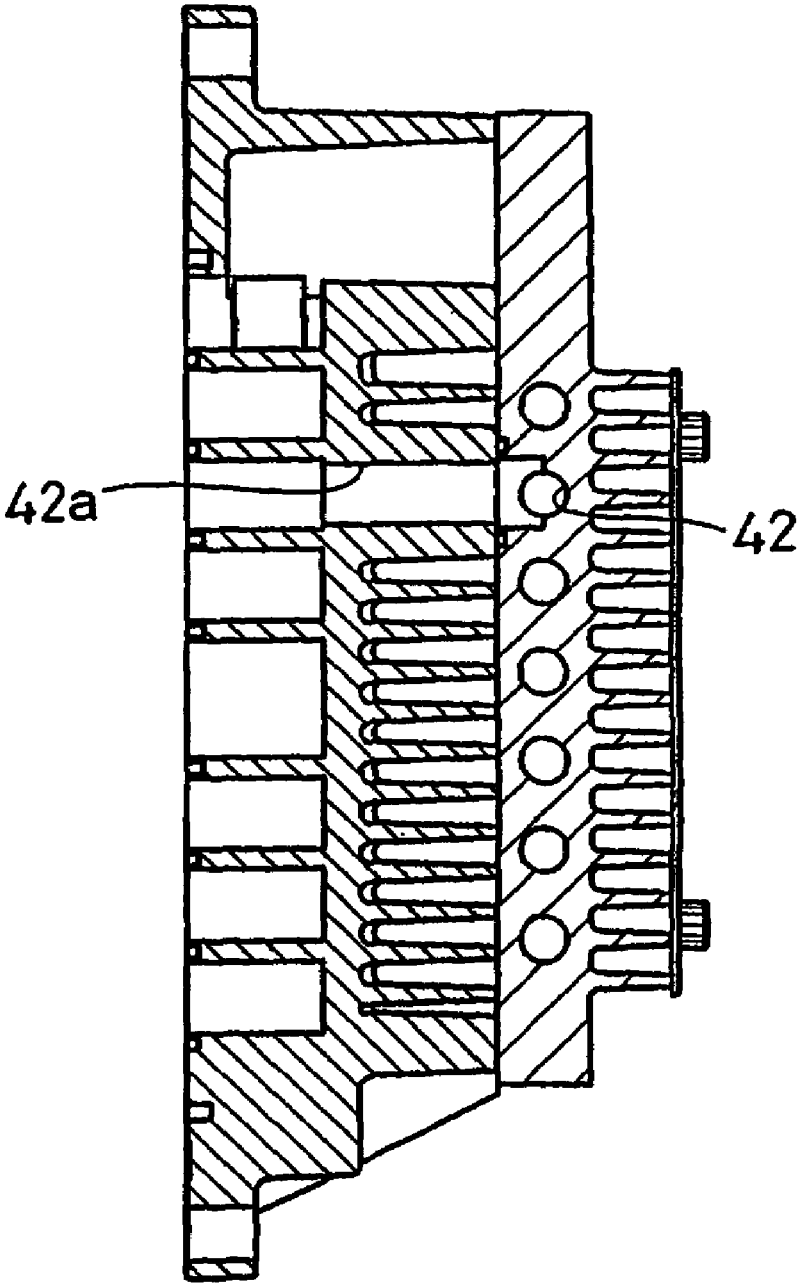
FIG. 8 shows a vertical section view of the fourth embodiment of the invention.
Figure 9:
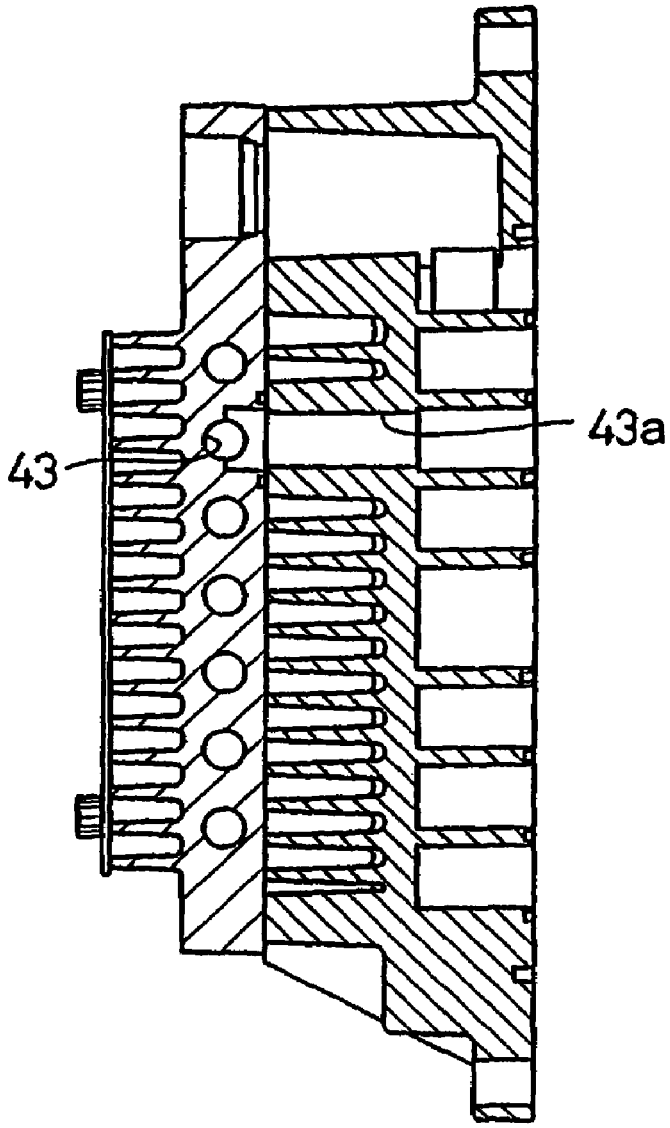
FIG. 9 shows a vertical section view of the fourth embodiment of the invention.
Figure 10:
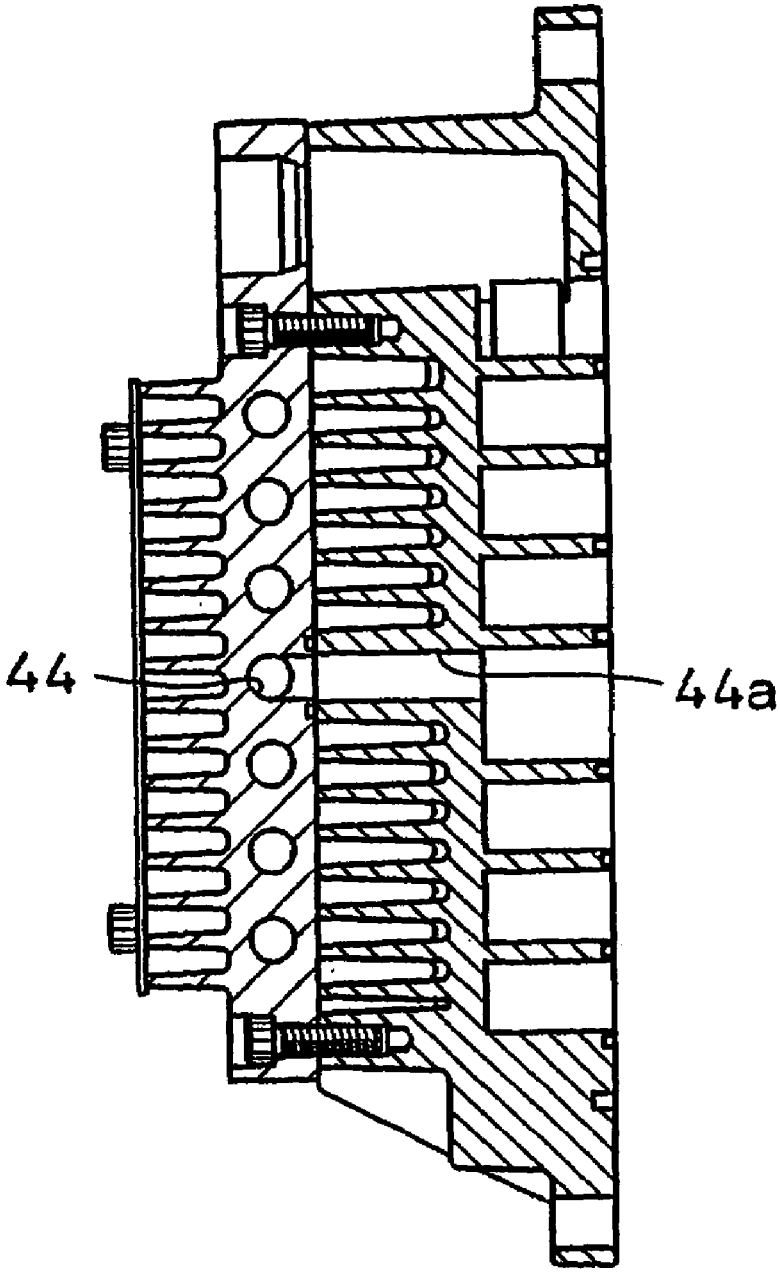
FIG. 10 shows a vertical section view of the fourth embodiment of the invention.

FIG. 7 illustrates the fourth embodiment of the present invention and a cooler 39 therein is applicable to a single-winding two-step scroll air compressor in which a low-pressure pressurizing step portion is formed on the outer portion of stationary and orbiting wraps and a high-pressure pressurizing step portion is formed on the inner portion, thereby further pressurizing, in the high-pressure pressurizing step portion, air pressurized and discharged from the low-pressure pressurizing step portion. As to a body of the single-winding two-step scroll air compressor, detailed description is omitted. A cooler 39 has substantially the same shape as the cooler 21 in the first embodiment, and the same numerals are allotted to the same members.

In the cooler 39 mounted to the front of a stationary end plate 4 of a stationary scroll 2, there are independently formed an intermediate cooling portion 40 that has a plurality of cooling paths 27 that communicate with each other; and a rear cooling portion 41 that has a plurality of cooling paths 27 different from the above cooling paths 27 and communicating with each other under the intermediate cooling portion 40.

In a middle cooling path 27 of an intermediate cooling portion 40, there are formed a low-pressure discharge bore 42 that communicates with a low-pressure outlet of the stationary scroll; and a high-temperature intake bore 43 that communicates with a high-temperature inlet of the stationary scroll.

At the end of the highest shorter cooling path 27 of the rear cooling portion 41, there is formed a high-pressure discharge bore 44 that communicates with a high-pressure outlet of the stationary scroll; and a cooling discharge bore 29 at the upper end of a communicating path 28.

Air that is pressurized by the low-pressure pressurizing portion of a single-winding two-step scroll air compressor flows to the cooling path 27 of the intermediate cooling portion 40, and cooled while it runs as shown by arrows. Cooled air flows into the high-pressure pressurizing step portion of the compressor through the high-pressure intake bore 43.

Air pressurized in the high-pressure pressurizing step portion flows into the cooling path 27 of the rear cooling portion 41 through the high-pressure discharge bore 40 and cooled while it runs as shown by arrows. Air cooled in the rear cooling portion 41 is discharged into an air tank through a discharge pipe connected to the cooling discharge bore 29.

As achieved in this embodiment, the intermediate cooling portion 40 and the rear cooling portion 41 are provided in the cooler 39, and mounted to a single-winding two-step scroll air compressor. Conventionally, air discharged from a low-pressure pressurizing step portion is cooled by a separate intermediate cooler, but in this invention, air can be cooled by a single cooler 39, thereby reducing size of a compressor unit to decrease manufacturing cost significantly.

As described above, in the embodiments of a scroll air compressor, high-temperature air discharged from the compression chamber 17 of the scroll body 1 is cooled with the coolers 21, 34, 35, 39 on the front of the stationary scroll and discharged, thereby preventing decrease in pressure-storage efficiency of an air tank and preventing an air tool from being heated to lengthen its life.

A cooler that is small and simple in structure can be installed in the compressor 1 easily, thereby omitting necessity of connection to a separate cooler, making the compressor itself smaller and decreasing manufacturing cost.

The present invention is also applicable to a multi-step scroll air compressor which comprises one or more low-pressure pressurizing step portion for pressurizing air pressure to a predetermined pressure, and one or more high-pressure pressurizing step portion for further pressurizing air pressurized in the low-pressure pressurizing step portion, air pressurized in the low-pressure pressurizing step portion being cooled by an external cooler to introduce into the high-pressure pressurizing step portion.

Furthermore, the present invention is also applicable to a double-wrap scroll or one- or multi-step compressor that has a orbiting wrap on both sides of an end plate of a orbiting scroll, the above cooler beings mounted to a stationary scroll end plate to provide functions as rear or intermediate cooler. An air inlet into the coolers 21, 34, 35 may be connected to an air discharge bore at the center of a high-pressure pressurizing step portion.

The foregoing merely relates to embodiments of the invention. Various modifications and changes may be made by a person skilled in the art without departing from the scope of claims wherein:

What is claimed is:

1. A scroll-type fluid machine comprising:

a stationary scroll comprising a stationary end plate which has a stationary wrap which axially extends at a vertical end face of said stationary end plate;

an orbiting scroll having an orbiting wrap which is engaged with said stationary wrap of said stationary scroll, air being compressed by revolving said orbiting scroll with respect to the stationary scroll; and said stationary end plate having a discharge bore and a cooling path that is a horizontally zig-zag shape and connected to the discharge bore to allow the compressed air to flow in the cooling path, said stationary end plate having a plurality of corrugated fins projected on a front surface of said stationary end plate, said plurality of fins extending horizontally in parallel with each other to allow heat of the air in the cooling path to transfer effectively via the stationary end plate and the said plurality of fins.

2. A scroll-type fluid machine as claimed in claim 1 further comprising a fan at an opening of a blower duct surrounding the stationary end plate, said fan moving external air to cool the stationary end plate forcedly.

3. A scroll-type fluid machine as claimed in claim 2 wherein the fan comprises a sucking fan that sucks air to cool the stationary end plate.

* * * * *